US009695839B1

(12) United States Patent
Polston

(10) Patent No.: US 9,695,839 B1
(45) Date of Patent: Jul. 4, 2017

(54) SUBMERSIBLE PUMP WATER JETTER

(75) Inventor: Henry B. Polston, Friendswood, TX (US)

(73) Assignee: US Submergent Technologies, LLC, Sarasota, FL (US)

( * ) Notice: Subject to any disclaimer, the term of this patent is extended or adjusted under 35 U.S.C. 154(b) by 536 days.

(21) Appl. No.: 12/478,547

(22) Filed: Jun. 4, 2009

(51) Int. Cl.

| | |
|---|---|
| ***E03F 9/00*** | (2006.01) |
| ***F04D 13/04*** | (2006.01) |
| ***F04D 7/04*** | (2006.01) |
| ***B05B 3/02*** | (2006.01) |
| ***F04F 1/18*** | (2006.01) |
| ***E02B 1/00*** | (2006.01) |
| *B08B 9/02* | (2006.01) |
| *B08B 9/049* | (2006.01) |

(52) U.S. Cl.
CPC ..... *F04F 1/18* (2013.01); *E02B 1/003* (2013.01); *E03F 9/00* (2013.01); *F04D 7/04* (2013.01); *F04D 13/046* (2013.01); *B08B 9/02* (2013.01)

(58) Field of Classification Search
CPC ..... B08B 3/02; B08B 9/0321; B08B 9/0433; B08B 2203/027; F04D 13/046; F04D 7/04; E03F 9/00
USPC .... 134/169 R, 169 C, 166 C, 184, 195, 172, 134/173, 187, 191, 198; 417/75, 76, 118, 417/151
See application file for complete search history.

(56) References Cited

U.S. PATENT DOCUMENTS

| | | | | |
|---|---|---|---|---|
| 3,334,816 | A * | 8/1967 | Mizuno | 239/18 |
| 4,308,138 | A * | 12/1981 | Woltman | 210/220 |
| 5,336,333 | A | 8/1994 | Sheppard et al. | |
| 5,415,352 | A * | 5/1995 | May | 239/365 |
| 6,178,570 | B1 * | 1/2001 | Denst et al. | 4/541.6 |
| 6,533,033 | B2 * | 3/2003 | Skillman | 166/105.1 |
| 6,736,572 | B2 * | 5/2004 | Geraghty | 405/211 |
| 2010/0119381 | A1 * | 5/2010 | Scarsdale | 417/53 |

FOREIGN PATENT DOCUMENTS

| | | | | |
|---|---|---|---|---|
| GB | 544459 | A * | 4/1942 | F04D 29/605 |
| JP | 2004066012 | A * | 3/2004 | |

OTHER PUBLICATIONS

Machine translation: JP2004-066012, Tanaka et al., Mar. 4, 2004.*

* cited by examiner

*Primary Examiner* — Michael Kornakov
*Assistant Examiner* — Natasha Campbell
(74) *Attorney, Agent, or Firm* — McDonald Hopkins LLC

(57) ABSTRACT

An apparatus and method for cleaning containers using water within the container and a submersible pump exhibiting a nozzle. Air may be injected into the pumped water to increase its pressure as it exists the nozzle.

17 Claims, 2 Drawing Sheets

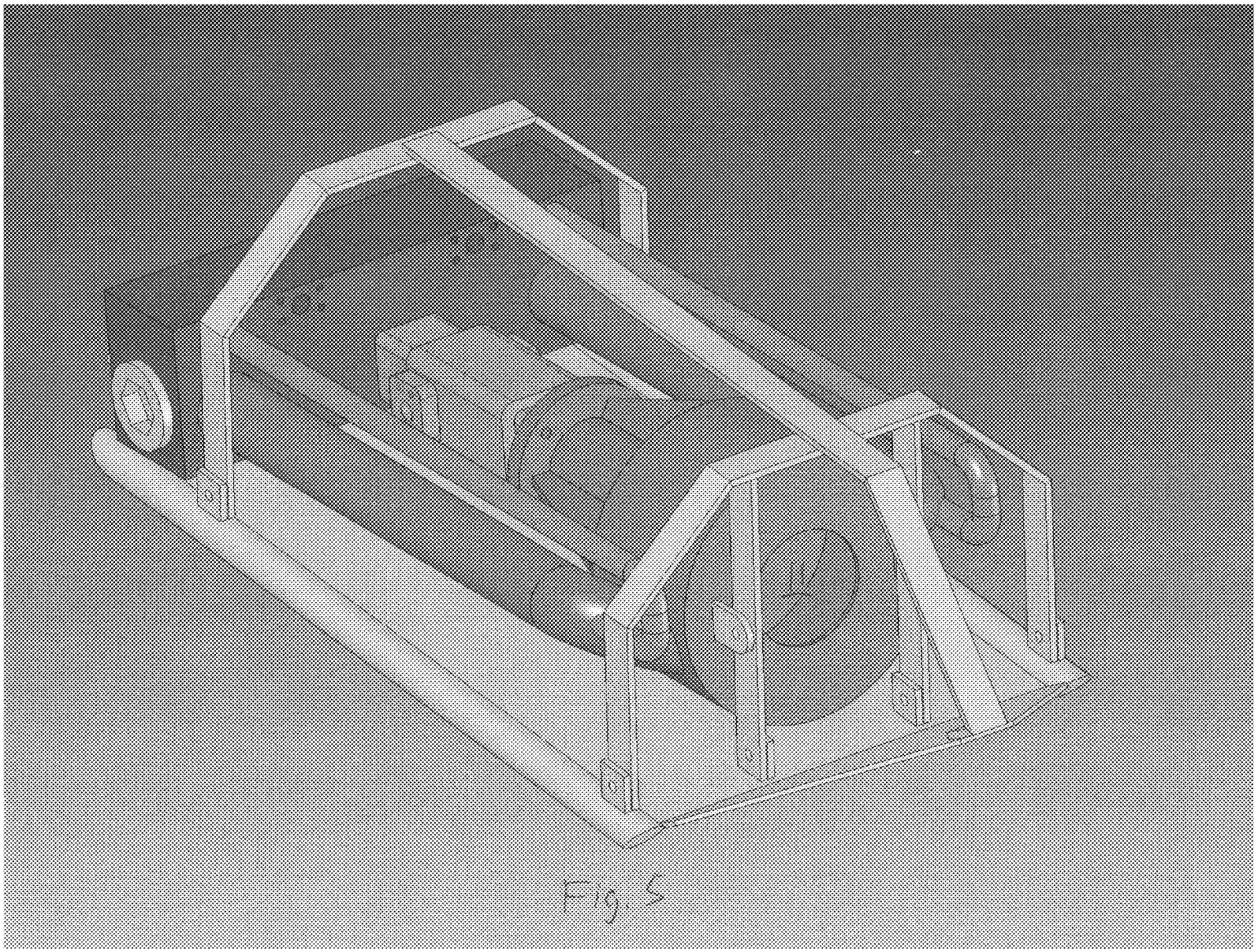
2
3
4
5
6
7
8
9
10
11
12
13
14
15
16
17
18
19
20
21
22
23
24
25
26
27
28
29
30
31
32
33
34
35
36
37
38
39
40
41
42

SUBMERSIBLE PUMP WATER JETTER

FIELD OF THE INVENTION

The invention is in the field of jetter cleaning of containers.

BACKGROUND OF THE INVENTION

Water jetters are used to clean containers, such as sewer pipes, tanks, and ponds. Powerful triplex pumps are used in such applications to create jets of cleaning water, but triplex pumps are sensitive to debris intake and must normally be located outside of the container. For example, use of triplex pumps in sewer cleaning requires use of expensive clean water, such as potable hydrant water. Thus, present sewer cleaning often wastes much potable water.

The instant invention solves a long-existing need for a water jetter for use within containers, having submersible capability, using debris-laden waste water to jet, and generating pressure equal to or greater than that of triplex pumps. Its use of waste water instead of potable water saves money, preserves an important natural resource, and is friendly to the environment.

BRIEF SUMMARY OF THE INVENTION

The invention employs a submersible pump to jet water through a nozzle. Venturi air or pressurized air may be used to enhance the pressure of the jetted water.

BRIEF DESCRIPTION OF THE DRAWINGS

FIG. 5 is second perspective view of an embodiment of the invention.

DETAILED DESCRIPTION OF THE INVENTION

Figure 1:
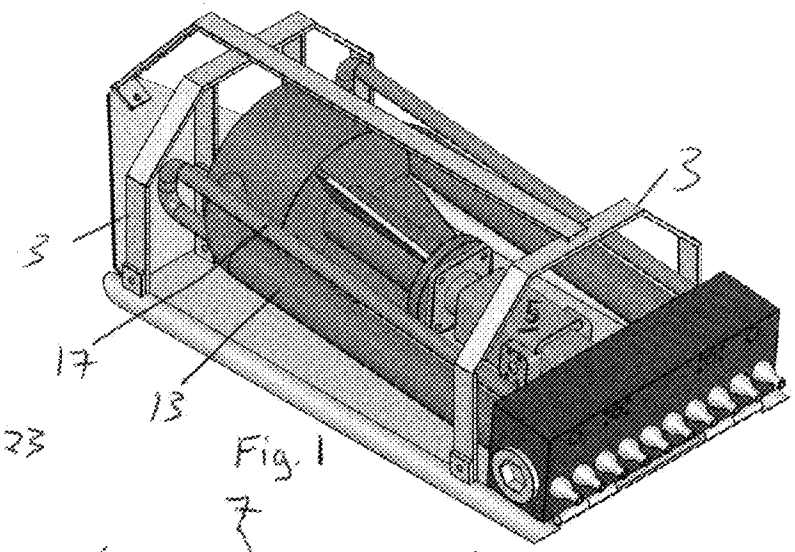
FIG. 1 is a perspective view of an embodiment of the invention.
Figure 4:
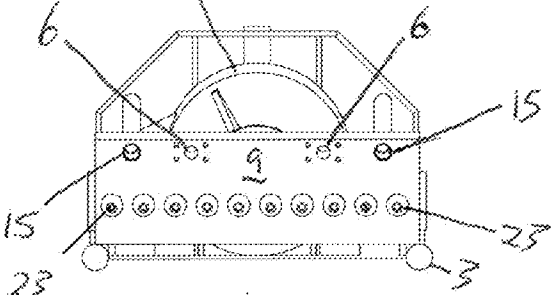
FIG. 4 is a back view of an embodiment of the invention.
Figure 2:
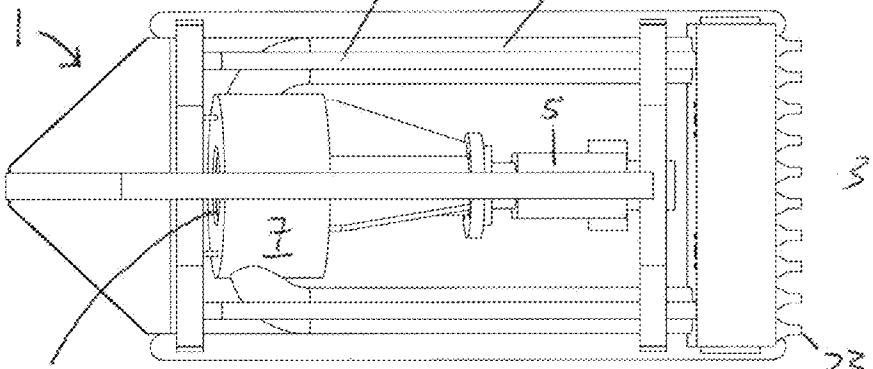
FIG. 2 is a top view of an embodiment of the invention.
Figure 3:
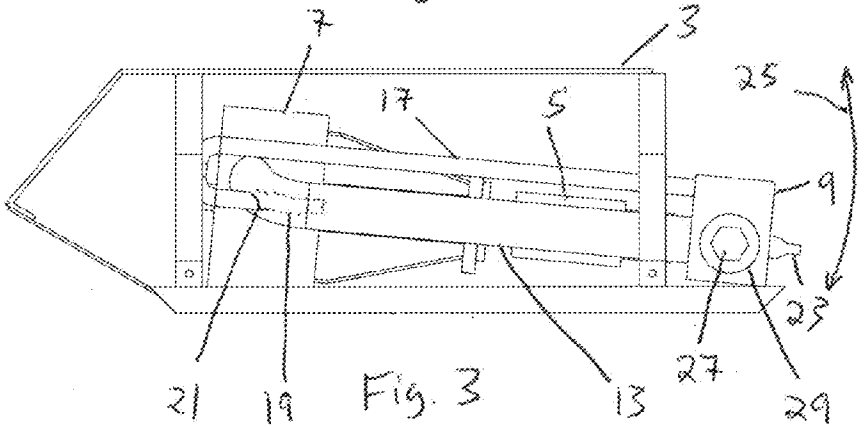
FIG. 3 is a side view of an embodiment of the invention.

Referring to the Figures, a jetter assembly 1 comprises a removable skid cage 3, a hydraulic motor 5, a submersible centrifugal pump 7, and a nozzle assembly 9. The hydraulic motor 5 is driven by hydraulic fluid, received through hydraulic fluid intake 6, from a hydraulic pump (not shown). The hydraulic motor, in turn, rotates an impeller (not shown) within the submersible centrifugal pump 7. When submersed in water, the rotating propeller of the centrifugal pump 7 draws water (not shown), into water intake 11 and into the pump 7, from where it is pumped, at a pressure such as 300 psi and at a volume such as 2000 gpm, through water conduits 13 into nozzle assembly 9 and out nozzles 23.

Air at ambient pressure may be drawn into water conduits 13 via air intakes 15 and air conduits 17. The air enters the water conduits 13 at injection points 21. Injection tubes 19 within water conduits 13 are a continuation of air conduits 17. At ambient air pressure, the air is drawn into the conduits 13 by the venturi effect, as pumped water flows through the water conduits 13.

Air also may be pressurized to a pressure greater than the water pressure created by the pump 7, such as 2000 psi. The pressurized air may be injected into air intake 15 by a pressurized air supply (not shown) through air conduits 17 and injection tubes 19. The pressurized air is released into water conduits 13 through air tubes 19 that enter water conduits 13 at injection points 21.

The injection of air into water conduits 13 substantially increases the pressure of the water as it flows past the air tubes 19. Ambient pressure air is suitable, but higher air pressure increases still further the pressure of the water. The pressure-enhanced water is further driven into nozzle assembly 9, from where the pressure-enhanced water, mixed with the air, is ejected through nozzles 23.

The vertical angle of attack of the nozzle assembly 9 may be adjusted by lifting or lowering the nozzle assembly 9 by generally rotating the assembly within the skid cage 3 about an axis proximal the water intake 11. A range of adjustment is generally indicated by arrows 25.

To use the jetter assembly 1 in the cleaning of a sewer pipe containing flowing waste water, the assembly 1 is connected by hose to a surface supply of pressurized hydraulic fluid and lowered into a manhole. A second hose with ambient or pressurized air may be added. The assembly 1 is oriented with the nozzles downstream the flow of water in the sewer pipe. The jetter assembly 1 is then activated by the hydraulic fluid, driving the centrifuge pump 7. Sewer water entering the water intake 11 is ejected from nozzles 23, driving the jetter assembly 1 a suitable distance upstream from the force of the ejected water. Venturi or pressurized air may be injected to increase the ejected water pressure. Upon reaching the suitable distance, the activated jetter assembly is slowly retracted through the pipe toward the manhole by the pressurized air hose, pressurized hydraulic fluid hose, or other tether between the jetter assembly 1 and the surface above the manhole. As the jetter assembly 1 is refracted, water ejected by nozzles 23 lifts and pushes solids in the sewer pipe downstream and toward the manhole, creating a slurry that can be removed by a submersible pump located in the pipe at approximately the manhole, such as reflected in U.S. Pat. No. 5,336,333.

In sewer pipe and other applications in which the water drawn into the water intake 11 may contain significant, large solids, a screen (not shown) may be placed over water intake 11 to minimize solids intake. Also, solids accumulating in nozzle assembly 9 may be removed by removing the cap 27 of clean-out port 29 and cleaning within the nozzle assembly 9.

"Containers" means any container that may be accessed, including without limitation pipes, tanks, and ponds. With the benefit of this disclosure, one of ordinary skill will understand that the air injection may be configured in a variety of ways, including structure and location variations, suitable for enhancing the pressure of water pressurized by a submersible pump. "Submersible pump" means any pump that operates submerged in water, including without limitation impeller pumps and disk pumps. "Nozzle" means any passageway configured to clean the inside of a container with jetted water.

With the benefit of this disclosure, one of ordinary skill will appreciate that many embodiments of the invention may be employed within the scope of the claims for a variety of applications.

I claim:

1. A fetter comprising:

a portable, submersible pump having a water intake and a water exhaust;

a submersible hydraulic motor having a hydraulic fluid intake, said hydraulic motor operatively coupled with the submersible pump to control a rate at which water flows from the water intake to the water exhaust in the submersible pump;

a nozzle in communication with the water exhaust, wherein the nozzle expels water from the submersible pump at a pressure to remove partially or fully submerged debris from a container and produce a waste slurry; and wherein the submersible pump, hydraulic motor, hydraulic fluid intake and nozzle are selectively positionable within the container;

a passageway for injection of air into the water exhaust, said injection of air further increasing the pressure of water expelled from the nozzle.

2. The jetter of claim 1 further comprising a skid cage generally enclosing the submersible pump.

3. The jetter of claim 2, wherein the nozzle is pivotable relative to the skid cage.

4. The jetter of claim 1, wherein the submersible pump pumps water at a volume of approximately 2000 gallons per minute.

5. The jetter of claim 1 further comprising:

a liquid conduit having proximal and distal ends in communication with an exhaust of the submersible pump, the distal end in communication with the nozzle; and a gas intake in communication with the liquid conduit, the gas intake configured to pressurize liquid in the conduit to a pressure greater than a pressure of the liquid in the proximal end of the liquid conduit.

6. A fetter comprising:

a nozzle;

a pump;

a liquid conduit having proximal and distal ends in communication with an exhaust of the pump, the distal end in communication with the nozzle;

a gas intake in communication with the liquid conduit, the gas intake configured to pressurize liquid in the liquid conduit to a pressure greater than a pressure of the liquid in the proximal end of the liquid conduit; and wherein the nozzle expels water at a pressure and is rotatably adjustable to vary an angle of attack of the expelled water to remove partially or fully submerged debris from a container, resulting in creation of a waste slurry, and wherein force exerted by the expelled water also to drives or moves the jetter along a surface to be cleaned within the container.

7. The jetter of claim 6 in which the pump is a submersible pump.

8. The jetter of claim 6 further comprising a skid cage generally enclosing the pump.

9. The jetter of claim 8, wherein the nozzle is pivotable relative to the skid cage.

10. The jetter of claim 8 further comprising a hydraulic motor operatively engaged with the pump.

11. The jetter of claim 10 further comprising a screen operatively engaged with the pump to generally prevent solids from entering the pump.

12. The jetter of claim 11 further comprising a clean out port positioned in the nozzle.

13. The jetter of claim 12 further comprising a removable cap positioned generally over the clean out port.

14. A jetter for cleaning water-containing containers comprising:

a hydraulically driven water pump exhibiting a water intake and a water exhaust, the water pump pressurizing water drawn from the container to a first pressure;

a water exhaust conduit exiting the water pump;

a gas conduit in communication with the water exhaust conduit, the gas conduit further pressurizing the water within the water exhaust conduit to a second pressure; and a nozzle in communication with the water exhaust conduit, the nozzle releasing water at the second pressure, which is greater than the first pressure, whereby the second pressure removes partially or fully submerged debris from a container and drives the water pump within the container.

15. A jetter for cleaning water-containing containers comprising:

a water pump hydraulically driven;

a water intake operatively engaged with the water pump, wherein the water pump is configured to pressurize water to a first pressure;

a water exhaust conduit exiting the water pump;

a gas conduit in communication with the water exhaust conduit, the gas conduit configured to further pressurize the water within the water exhaust conduit to a second pressure that is greater than the first pressure, said first and second pressures also exceeding ambient water pressure exerted on the jetter;

at least one nozzle in communication with the water exhaust conduit, the nozzle releasing water exhibiting a pressure greater than the first pressure, whereby the pressure removes partially or fully submerged debris from a container to create a waste slurry and moves the jetter within the container; and a skid cage engaged with the at least one nozzle wherein the at least one nozzle is selectively rotatable relative the skid cage.

16. A jetter comprising:

a hydraulically driven pump having an intake and an exhaust;

a liquid conduit having proximal and distal ends in communication with the exhaust of the pump;

a gas intake in communication with the liquid conduit, the gas intake configured to pressurize liquid in the conduit to a pressure greater than a pressure of the liquid in the proximal end of the liquid conduit;

a nozzle assembly in communication with the distal end of the liquid conduit, wherein the nozzle expels water at a pressure to remove partially or fully submerged debris from a container to create a waste slurry and to move the jetter within the container; and a screen operatively engaged with the pump intake generally preventing solids from entering the intake of the pump.

17. The jetter of claim 16, wherein the nozzle assembly includes a plurality of nozzles that are selectively rotatable.

* * * * *